United States Patent [19]

Bienholz

[11] 4,075,945

[45] Feb. 28, 1978

[54] PRINT MEDIUM AND ASSEMBLY

[76] Inventor: Siegfried Heinz Bienholz, 43 Blamey St., East Bentleigh, Victoria, Australia

[21] Appl. No.: 630,647

[22] Filed: Nov. 10, 1975

[30] Foreign Application Priority Data

Nov. 12, 1974 Australia ..... 9585/74

[51] Int. Cl.[2] ..... B41J 1/20

[52] U.S. Cl. ..... 101/111; 101/93.14; 197/49; 197/53

[58] Field of Search ..... 101/111, 122, 93.13, 101/93.14, 93.15, 93.16, 93.17, DIG. 13; 197/49–55, 57; 96/27 H

[56] References Cited

U.S. PATENT DOCUMENTS

| | | | |
|---|---|---|---|
| B 496,999 | 1/1976 | Thienemann | 101/93.13 |
| 2,831,424 | 4/1958 | McDonald | 101/111 X |
| 2,901,540 | 8/1959 | Canepa | 101/93.13 X |
| 2,982,176 | 5/1961 | Kay | 96/27 H |
| 3,113,509 | 12/1963 | Simpson | 101/111 |
| 3,115,092 | 12/1963 | Sasaki | 101/93.14 |
| 3,133,497 | 5/1964 | Martin | 101/93.15 |
| 3,164,084 | 1/1965 | Paige | 101/93.13 |
| 3,314,360 | 4/1967 | Foster | 101/122 |
| 3,640,369 | 2/1972 | Rolph | 197/53 X |
| 3,793,951 | 2/1974 | Denley | 197/151 |

*Primary Examiner*—Edward M. Coven
*Attorney, Agent, or Firm*—Haseltine, Lake & Waters

[57] ABSTRACT

A print medium in the form of a stretchable band on which printing indicia are discretely arranged in linear array. The band may be incorporated in a typewriter or like device, selection of a character being effected by stepwise movement of the band to bring the appropriate indicium to a printing station which is relatively moveable along the printline.

11 Claims, 6 Drawing Figures

PRINT MEDIUM AND ASSEMBLY

This invention relates to a novel print medium and to a print assembly containing the medium. In one particular but by no means exclusive aspect, the invention is concerned with a typewriter incorporating such a print assembly.

Recent developments in the construction of typewriters have included the provision of print medium in the form of a so called "golf ball" on which are embossed discrete indicia capable of rendering impressions of the respective characters to be available for printing. The platen is stationary and the golf ball is accordingly mounted on a carriage which is stepwise movable along the printline by suitable escapement mechanism. On selection of a character by depressing the appropriate keyborad striker, the golf ball is rapidly rotated to bring the related indicium to a printing station facing the platen and then nipped forwardly to engage paper covering the platen through an intervening ink ribbon. The selection and escapement mechanism for this design of typewriter is necessarily complex and is found to by subject to high wear and tear.

An alternative, somewhat simpler arrangement is described in U.S. Pat. No. 3,133,497 to C. R. Martin. This structure includes a belt on which chosen indicia are embossed. The belt is movable past a printing station along spaced, parallel rigid guideways by an electric stepping motor and printing is effected by forward deformation of the belt under the action of a striking hammer which is movable to each successive print position along the printline. In this structure, the belt is capable of free movement in its guideways as it is drawn in during the actual printing step.

Devices in which printing indicia are provided on an endless web or belt are known in the field of "on-the-fly" printers and examples of these are to be found in U.S. Pat. Nos. 3,216,348, 3,605,613, 3,697,958 and 3,719,139.

It is an object of this invention to provide new and improved printing apparatus, and in particular a new and improved typewriter, which has fewer mechanically operative parts than hitherto and is reliable and accurate in operation. This object is realized in the provision of a novel print medium comprising a multiplicity of indicia discretely arranged on a flexible band whereby a discrete representation of the respective indicia can be transposed by suitable means to a further adjacent medium, characterized in that the band is extensible to increase the separation of the indicia.

This medium may be advantageously incorporated in a print assembly which further includes:

- guide means engaged with the medium to define a printing station;
- means to effect stepwise movement of the medium past the printing station whereby said indicia may be selectively brought to the printing station;
- advance means to displace the print medium at the printing station in a direction parallel to the thickness dimension of the band, whereby to position a selected indicia in readiness for a printing operation; and
- constraint means acting on the band so that said displacement acts to stretch the band and thereby increase separation of its indicia at the printing station.

The flexible band may be closed and be formed in a uniform flexible substance such as natural or synthetic rubber. Alternatively, it may comprise a chain of rigid webs flexibly interconnected as, for example, by resilient links. The indicia may be suitably shaped protuberances in the case where printing is effected by rendering a physical impression on the further medium. Alternatively, the indicia may, for example, consist of appropriately shaped perforations through the band for use in a photographic and/or laser printing process.

The means for effecting stepwise movement of the medium in the print assembly is preferably an electric stepping motor and the print assembly is advantageously included in a typewriter in which it may be mounted either on a carriage supported for stepwise movement along the print line by suitable escapement mechanism or as a fixed unit in association with a transversely movable platen.

The invention will now be described by way of example with reference to the accompanying drawings, in which.

Figure 1:
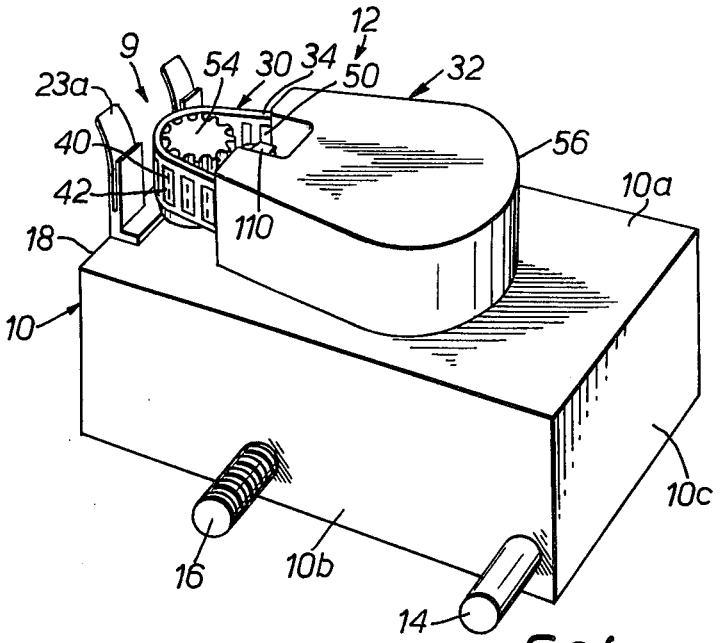
FIG. 1 is a perspective view of printing apparatus incorporating a print medium constituting a first embodiment of the invention, the assembly being mounted on a carriage for transverse movement in a typewriter.
Figure 2:
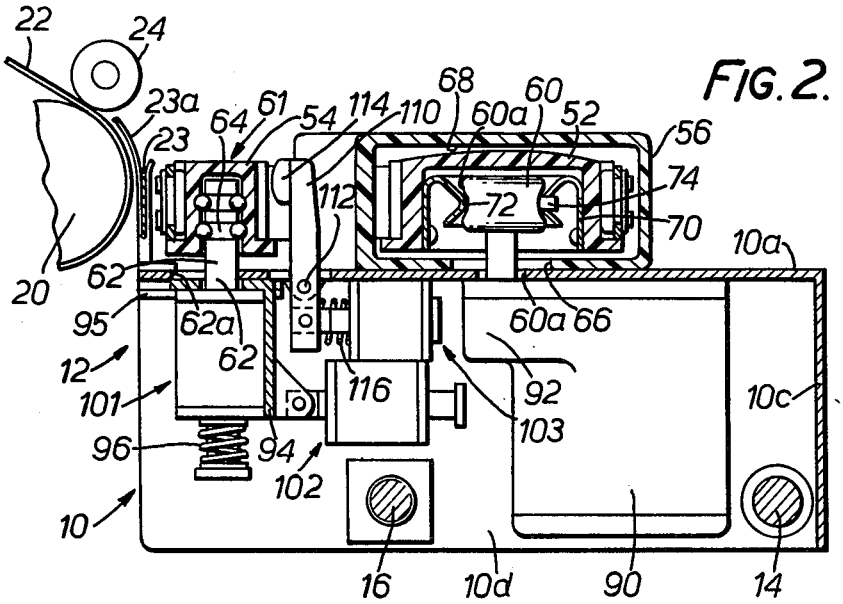
FIG. 2 is a central vertical cross-section through the apparatus shown in FIG. 1.
Figure 3:
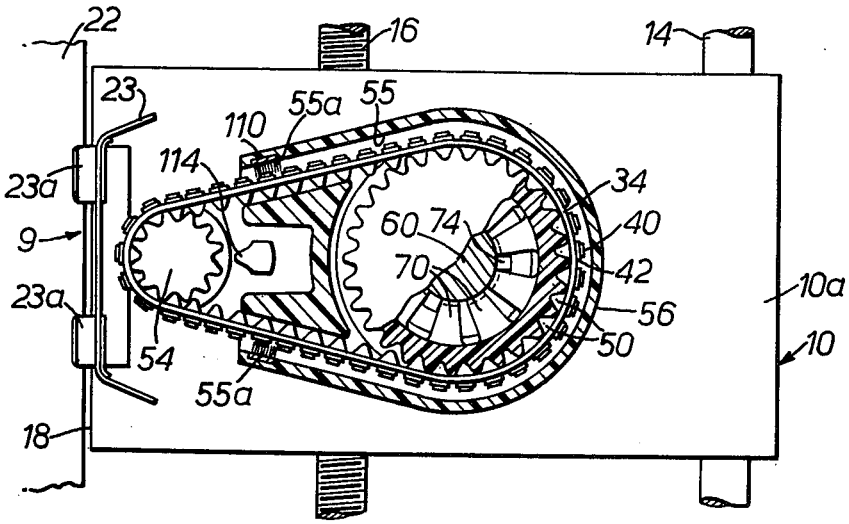
FIG. 3 is a partly sectioned plan view of the apparatus of FIGS. 1 and 2.

The apparatus illustrated in FIGS. 1 to 4 includes a carriage 10 of generally rectangular configuration which supports the print assembly 12 and is itself slidably supported on a guide rail 14 for stepwise movement under the action of an escapement mechanism (not wholly shown) including a lead screw 16. This apparatus forms part of a typewriter which is not specifically detailed. Suffice to say that carriage 10 includes an upper front edge 18 the centre of which is located just below a printing station 9 which may be moved by way of the aforementioned escapement mechanism along a printline backed by a cylindrical platen or roll 10 (FIGS. 2 and 3). Medium 22 such as paper or the like is wrapped partially about platen 20 in use of the typewriter and retained in place by a weighted or spring-loaded pivotable bar 24. A conventional ink ribbon 23 is guided past the paper 22 and through resilient ribbon pegs 23a. Carriage 10 can be regarded as being substituted for the "golf ball" of modern electric typewriters.

The details of the escapement mechanism including lead screw 16 are peripheral to the invention. For example, the lead screw may well by replaced by a pair of cables or by any other suitable mechanism for effecting stepwise motion of the carriage from one print position on the printline to the next. For that matter, carriage 10 may be stationary and the necessary relative movement along the print line achieved by movement of platen 20, as in some older or more basic styles of typewriter.

Carriage 10 includes an upper plate wall **10*a* terminating in the aforementioned fornt edge 18, respective side walls 10b and a back wall 10c. A print medium 30 formed in accordance with the invention is provided in a cassette 32 which is releasably carried in the upper surface of plate 10a. The underside of plate 10a mounts operational mechanism to be described in greater detail in due course. This mechanism is coupled to the print medium by way of guide means 61 centred adjacent edge 18 and a drive spindle 60 having a shallow out-facing annular groove 60a. Guide means 61 comprises a sprocket wheel 54 freely mounted for sliding and rotational movement on an upstanding pin 62 by way of a pair of ball races 64. Spindle 60 and pin 62 project through respective apertures 60a, 62a in carriage plate 10a**.

Figure 4:
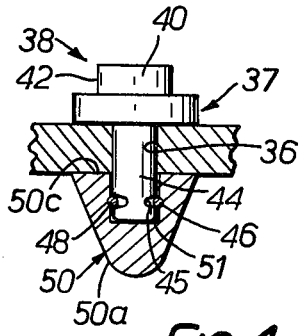
FIG. 4 is an axial cross-section through a representative indicia and sprocket tooth stud forming part of the apparatus of FIGS. 1 to 3.

Medium 30 comprises an endless band 34 of natural or synthetic rubber whereby the band is readily flexible in the sense that its lengthwise centre line is flexible transversely of its thickness, and extensible or stretchable so as to increase its overall length. Band 34 is provided with a total of 45 identical circular perforations 36 disposed at equi-spaced intervals along its lengthwise centre line. Each of these perforamtions mounts a two-part press stud 38 (FIG. 4).

The male part 37 of each stud 30 is provided by an assembly of a pair of printing indicia 40 on a base wafer 42 which in turn carries a pin 44 extending through aperture 36 so that indicia 40 are located to the outside of the band, one directly above the other, with wafer 42 abutting the surface of the band. Pin 44 carries an annular groove 45 dimensioned to wholly receive an expansible anchor ring 46. The female part of each stud 38 comprises an elongate solid cap 50 having a longitudinally uniform convex outer surface 50a, tapered side surfaces 50b and a flat underside 50c. A central closed recess 51 has an annular groove 48 arranged to co-operate with groove 46 to receive ring 46 in an expanded condition in a snap-on/snap-off engagement to secure the stud in a perforation 36, as shown in FIG. 4. When parts 37,50 are fitted together, the outer end face of pin 44 abuts the end of recess 51. It will be realised that any one of the press studs 38 may be readily exchanged for another having different indicia where this is desired.

Indicia 40 are conventional and each comprises a protuberance having an outer surface which is capable of leaving an impression of a chosen recognizable character, such as an alphabetical letter or numeral, on being pressed through ink onto paper. It will seem that the indicia are arranged in upper and lower rows— one row might contain indicia for lower case letters and numerals and the other for upper case letters and punctuation symbols. Not all studs are necessarily occupied by meaningful indicia.

The 45 caps 50 form sprocket teeth by means of which the band is drivingly engageable about guide sprocket wheel 54 and about a larger drive sprocket wheel 52. Sprocket wheel 54 is largely enclosed within a closely fitting housing 56 providing the frame of the cassette 32 and having an inner curved wall disposed sufficiently close to the rim of sprocket 52 as to prevent disengagement of the band and the sprocket once the cassette has been assembled. Cassette 32 is mounted on carriage 10 by engaging sprocket wheel 52 with spindle 60 and by stretching band 34 to loop it around wheel 54.

Spindle 60 is received through an aperture 66 in housing 55 into a closed bore 68 in sprocket 52. Bore 68 fixedly mounts a plurality of overturned spring metal clips 70 about its periphery. Clips 70 include respective curved bulged portions 72 which co-operate to snap into groove 60a of spindle 60. Two of the clips 70 are spaced further apart than the others to provide a keying gap for a locating pin 74 projecting from spindle 60. By virtue of this arrangement, a secure but readily releasable driving engagement is effected between the spindle and the sprocket while the nature of the grooves and clips allows some rocking movement of the sprocket on the spindle without detriment to such engagement. Because the cassette is readily releasable, it may be readily substituted by another having a different set of indicia.

Housing 56 is releasably secured to carriage 10 by means of a permanent magnet (not shown) which is demagnetizable by an appropriate finger actuated control to allow removal of the cassette 10. The latter may be spring-seated on plate 10a for pop-up release on clamping of the magnetic field. Housing 10 includes entrance guide passages 55 for band 34 which passages are fitted with band cleaning brushes 55a.

Belt 34 is movable by means of an electric stepping motor 90 driveably engaged with spindle 60 to bring any chosen pair of indicia to the foremost position of the belt adjacent edge 18. This position constitutes the printing station 9 already mentioned and is located closely adjacent the platen 20. Three solenoid 101, 102, 103 are provided on the underside of plate 10a for effecting further steps in the printing sequence once an indicia pair has been positioned at the printing station. The coil of solenoid 101 is mounted about the lower end of pin 62 on a right angle slide 94 which is itself attached to the core of solenoid 102 for movement by the latter switch in side rails 95 towards platen 20 so as to bring guide sprocket 54 to a "ready to print" position close to the platen. Slide 94 is biased to move pin 62 away from platen 20 by virtue of the slightly stretched condition of band 34. Solenoid 101 is actuable to raise sprocket 54 against the action of a further helical tension spring 96 so as to move the band 34 from a lowered condition in which the upper row of indicia actually passes the printing station and a raised condition in which the lower row is so disposed. During this movement, sprocket 52 is freely responsive to the changed plane of the band without loss of drive by virtue of its particular mounting on spindle 60, as afore described.

The coil of solenoid 102 is fixed to the underside of plate 10a by way of the coil of solenoid 103 which actuates a striker arm 110. Arm 110 is pivoted at 112 to the underside of plate 10a and to the coil bar of solenoid 103 and carries at its upper end a solenoid stud 114 similar in cross-section to the caps 50 so as to be receivable on forward movement in the sprocket notches of sprocket wheel 54. This arrangement allows accurate centering of the indicium to be printed. Further movement of arm 110 is then effective to strike the selected indicium home onto the paper 22 to make an impression through the ink ribbon 23. Arm 110 is biased away from sprocket wheel 52 by a strong helical tension spring 116 disposed between the core of solenoid 103 and the lower end of the arm 110. By virtue of this spring, and of the initial advancing of the guide sprocket before actuation of the striker arm, the time during which the arm is engaged with the sprocket thus preventing rotation of the latter is minimised.

As already indicated, selection of the character to be printed is effected by means of the stepping motor 90 which is fixed under plate 10a. Operation of this motor is entirely electronic and thus, apart from the output drive of the motor and the movement of the band 34, the selection mechanism will be entirely electronic. In particular, the typewriter will be provided with a conventionally arranged key board having depression strikers, buttons, touch sensitive microswitches or whatever to trigger counter circuitry which includes an arithmetic logic circuit which determines the required number of motor pulses for a given selection and stores such information for comparison with the next succeeding selection as the next required number is counted out. Typically, the characters will be arranged on the band in a manner which minimizes selection time. For example, for a typewriter intended to type in the English language, this would be achieved, by arranging the alphabet about the letter E on the basis of decreasing frequency of occurrence. For the logic circuit to function correctly, the circuitry and motor must be fixedly synchronized with the band 34. As indicated previously, maintenance of this condition is provided by pin 74 and by reducing the gap between the inside wall of housing 55 and the band such as to preclude disengagement of the band from sprocket wheel 52. A hand wheel (not shown) may be provided on the cassette for turning sprocket 52 to correctly engage pin 74 on presentation of the cassette to the assembly.

It is clearly necessary that at the printing station, there be no interference with the printing of a chosen character by adjacent character indicia. Accordingly it is desirable that sprocket 54 be as small as possible so that the turning of the band can be as sharp as possible. The separation of the indicia can then be reduced so as to minimize the required diameter of sprocket 52 while maintaining maximum angular turn indicia. For stability, though, there is clearly a lower limit to the size of sprocket 54 and it is found that for type face of about pica size a suitable arrangement is provided by a guide sprocket diameter of about 17.66 mm in combination with a band length is 208 mm, giving an occupation of about 4.6 mm per indicia pair and a drive sprocket diameter of about 44.5 mm for a 12° movement of the drive sprocket per indicia. A differential 92 is provided if necessary where there is difference between the basic pulsed step of motor 90 and the step required of the drive sprocket.

Figure 5:
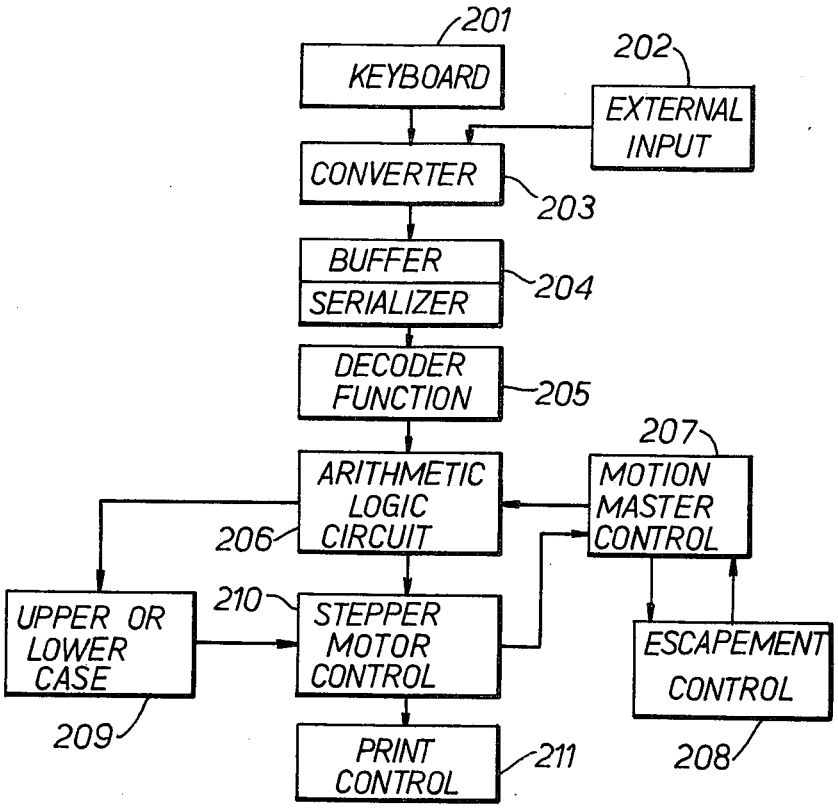
FIG. 5 is a flow chart for the control circuitry for a typewriter incorporating the apparatus of FIGS. 1 to 4.

FIG. 5 is a logic flow chart for the circuitry of the typewriter. A character entered via key board 201 or external input 202 (as in a teleprinter) will be converted to machine code at 203. The coded information will then be stored in a buffer or serializer 204. When preceding print has been completed, the arithmetic logic circuit 206 receives the next entry decoded at 205 and analyses its bit configuration in comparison with the completed entry so as to step the motor 90 so as to bring the chosen indicia pair to the printing station. Solenoid 101 is actuated if necessary at 209 for a proper choice of the row required. As soon as motor control circuitry 210 signals motor 90 to stop, solenoids 102 and 103 are triggered in turn by circuitry 211 to make the impression at the print position. A feed back from motor 90 to motion control 207 then activates the escapement mechanism 208 to move the carriage one position along lead screw 16, feed back from here looping to the arithmetic logic circuit to instruct it to fetch the next entry from storage. With this arrangement, it will be apparent that the typist can type faster than the actual rate of printing when temporarily desirable for purposes of efficiency.

The placing of the printing indicia linearly along a band makes it practicably possible to modify the escapement mechanism for the carriage movement by controlling the precise amount of movement required in response to a command from the logic memory in accordance with the character chosen. In this way, movement of the carriage can be varied in dependence on the character chosen, whereby, for example, narrower letters may occupy less printing space than larger letters.

Figure 6:
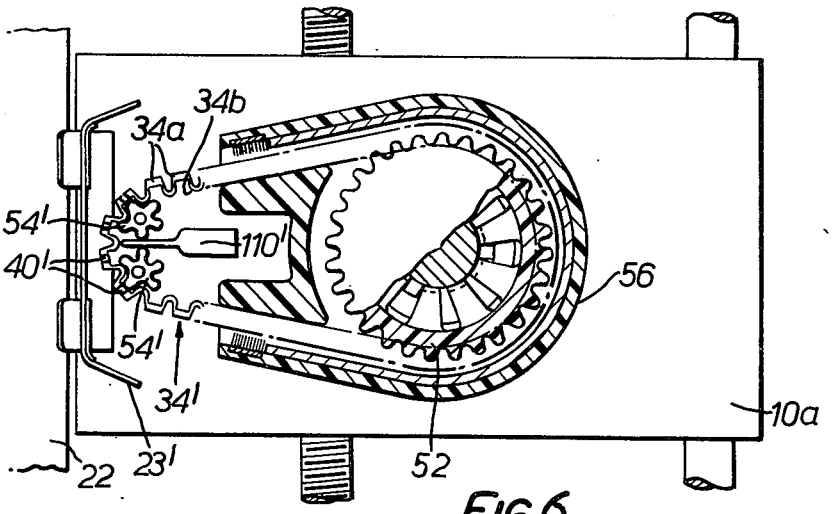
FIG. 6 corresponds to FIG. 3 but shows partially in section a print apparatus incorporating a print medium comprising a second embodiment of the invention.

A second embodiment of the invention is illustrated in FIG. 6. This embodiment differs, firstly, in that the extensible band, now indicated at 34' comprises a succession of spaced rigid webs **34*a* linked by inwardly looped flexible ties 34*b* which provide the sprocket teeth and render the band extensible as desired. Shaped indicia 40 are replaced by indicia 40' comprising shaped invariable apertures in webs 34*a***.

It will be appreciated that the construction particularly described is merely a preferred embodiment of this invention and that variations and modifications may be made to that construction without departing from the spirit and scope of this invention which includes every novel feature and combination of features herein disclosed.

I claim:

1. A printing apparatus employing a printing assembly comprising:

a pair of spaced upright shafts, a structure supporting said shafts, one shaft being fixed relative to the structure while the other is laterally displaceable relative to said one shaft in a direction substantially perpendicular to the axes of the shafts;

a wheel supported on said other shaft and being freely rotatable on said other shaft;

means for effecting lateral displacement of said other shaft in a direction away from said one shaft to a predetermined position relative to said one shaft;

a second wheel mounted on said one shaft for rotation therewith; and a continuous flexible band looped under tension around said wheels and carrying a multiplicity of indicia discretely arranged on the band whereby a discrete representation of the respective indicia can be transposed to a further medium, said band being resiliently extensible to increase the separation of the indicia;

an upright striker arm for engaging said wheel when the latter is in said predetermined position to thereby displace said wheel a further small distance away from said one shaft;

means for biasing the striker arm away from said wheel; and means for momentarily effecting said wheel displacing movement of the striker arm.

2. A printing assembly according to claim 1 further comprising means mounted on said structure for effecting stepwise rotation of said one shaft.

3. A printing assembly according to claim 2 wherein said structure comprises a carriage incrementally movable along guide means whereby said wheel may be brought to any one of a succession of printing positions.

4. A printing assembly according to claim 3 further comprising means for moving said other shaft axially between two spaced positions.

5. A printing assembly according to claim 2 wherein said wheel and striker arm are co-operable on engagement to accurately rotationally position the wheel relative to the striker arm.

6. A printing assembly according to claim 5 wherein the striker arm is pivotally supported on said structure so as to be movable.

7. A printing apparatus employing a printing assembly comprising:

a pair of spaced upright shafts, a structure supporting said shafts, one shaft being fixed relative to the structure while the other is laterally displaceable relative to said one shaft in a direction substantially perpendicular to the axes of the shafts;

a first wheel supported on said other shaft and being freely rotatable on said other shaft;

means for effecting lateral displacement of said other shaft in a direction away from said one shaft to a predetermined position relative to said one shaft;

an upright striker arm for engaging said wheel when the latter is in said predetermined position to thereby displace said wheel a further small distance away from said one shaft;

means for biasing the striker arm away from said wheel;

means for momentarily effecting said wheel displacing movement of the striker arm;

a second wheel mounted on said one shaft for rotation therewith; and a continuous flexible band looped under tension around said wheels and carrying a multiplicity of indicia discretely arranged on the band whereby a discrete representation of the respective indicia can be transposed to a further medium, said band being resiliently extensible to increase the separation of the indicia.

8. A printing assembly according to claim 7 further comprising means mounted on said structure for effecting stepwise rotation of said one shaft.

9. A printing assembly according to claim 8 wherein said structure comprises a carriage incrementally movable along guide means whereby said wheel may be brought to any one of a succession of printing positions.

10. A printing assembly according to claim 8 wherein said wheel and striker arm are co-operable on engagement to accurately rotationally position the wheel relative to the striker arm.

11. A printing assembly according to claim 8 further comprising means for moving said other shaft axially between two spaced positions, the second wheel being rockably mounted on said one shaft to accommodate the consequent alteration in the alignment of the belt.

* * * * *